US007635202B2

(12) United States Patent
Awabayashi

(10) Patent No.: US 7,635,202 B2
(45) Date of Patent: Dec. 22, 2009

(54) SELF-ILLUMINATED BANNER

(75) Inventor: Minoru Awabayashi, Tokyo (JP)

(73) Assignee: Main Bright (H.K.) Limited, Hong Kong (CN)

( * ) Notice: Subject to any disclaimer, the term of this patent is extended or adjusted under 35 U.S.C. 154(b) by 2 days.

(21) Appl. No.: 11/804,878

(22) Filed: May 21, 2007

(65) Prior Publication Data

US 2007/0268699 A1 Nov. 22, 2007

(30) Foreign Application Priority Data

May 22, 2006 (CN) ..... 2006 2 0113881 U

(51) Int. Cl.
*F21V 21/00* (2006.01)

(52) U.S. Cl. ..... 362/249.08; 362/249.15; 362/812

(58) Field of Classification Search ..... 362/250, 362/252, 320, 565, 34, 812
See application file for complete search history.

(56) References Cited

U.S. PATENT DOCUMENTS 4,709,307 A * 11/1987 Branom ..... 362/103
4,761,047 A * 8/1988 Mori ..... 607/88
5,162,696 A * 11/1992 Goodrich ..... 313/511
5,366,780 A * 11/1994 Rapisarda ..... 428/102
5,440,461 A * 8/1995 Nadel et al. ..... 362/103
5,455,749 A * 10/1995 Ferber ..... 362/103
5,575,098 A * 11/1996 Goettel-Schwartz ..... 40/550
5,881,481 A * 3/1999 Bashaw et al. ..... 40/593
6,395,369 B1 * 5/2002 Randone ..... 428/99
6,402,336 B1 * 6/2002 Reese ..... 362/103
6,443,590 B1 * 9/2002 Lovitt ..... 362/103
6,490,402 B1 * 12/2002 Ota ..... 385/147
6,969,185 B1 * 11/2005 Adair ..... 362/542
7,198,383 B2 * 4/2007 Martino ..... 362/249
7,374,315 B2 * 5/2008 Dorsey et al. ..... 362/294
2003/0046841 A1 * 3/2003 Arias ..... 40/542
2004/0080929 A1 * 4/2004 Golle et al. ..... 362/84
2006/0209547 A1 * 9/2006 Biondo et al. ..... 362/388
2007/0041168 A1 * 2/2007 Dodd ..... 362/34

FOREIGN PATENT DOCUMENTS

GB 2277797 A * 11/1994

* cited by examiner

*Primary Examiner*—Jong-Suk (James) Lee
*Assistant Examiner*—Leah S Lovell
(74) *Attorney, Agent, or Firm*—Alix, Yale & Ristas, LLP

(57) ABSTRACT

A banner includes a flexible display film having light-transmissive areas and a relatively opaque area surrounding the light-transmissive areas. A number of light sources are positioned at least behind each light-transmissive area. The light sources are attached to the flexible display film in such manner as to allow rolling up and folding of the banner without removal of the light sources therefrom.

13 Claims, 2 Drawing Sheets

SELF-ILLUMINATED BANNER

BACKGROUND ART

The present Invention relates to a self-illuminated banner. More particularly, although not exclusively, the Invention relates to an internally illuminated banner having shaped light-transmissive areas through which backlighting passes, as well as relatively opaque areas surrounding the shaped areas.

Backlit or internally illuminated signs for example are known. These typically comprise a light box having a glass or plastics "transparency" at the front. The light box might include incandescent light bulbs, fluorescent tubes, or electroluminescent panels for example. Such signs are bulky, cumbersome and rigid items intended for permanent fixture in situ.

Temporary flexible banners on the other hand are known to comprise simple printing requiring illumination from a remote external light source such as open daylight or spotlights for example.

OBJECT OF THE INVENTION

It is an object of the present Invention to overcome or substantially ameliorate at least one of the above disadvantages and/or more generally to provide a self-illuminated banner.

DISCLOSURE OF THE INVENTION

There is disclosed herein a banner, comprising:

a flexible display film comprising light-transmissive areas and a relatively opaque area surrounding the light-transmissive areas, and a plurality of light sources positioned at least behind each said light-transmissive area, and wherein the light sources are attached to the flexible display film in such manner as to allow rolling up and folding of the banner without removal of the light sources therefrom.

Preferably, the banner further comprises a flexible reflective film disposed adjacent to the flexible display film, and wherein the light source is disposed between the flexible display film and the flexible reflective film.

Preferably, the banner further comprises a plurality of flexible pockets attached to the flexible display film and within each of which a said light source is located, and wherein said pockets each comprise said flexible reflective film.

Alternatively, the banner further comprises a plurality of flexible light-transmissive pockets attached to the flexible display film and within each of which a said light source is located, and wherein the pockets are located between the flexible display film and the flexible reflective film.

Typically, the flexible display film is made of fibrous material.

The fibrous material might typically comprise paper or cardboard.

Alternatively, the flexible display film comprises synthetic plastics.

Typically, the synthetic plastics is selected from the group consisting of: polyethylene; polypropylene; and nylon.

Typically, said relatively opaque areas comprise a coating.

The coating is typically applied by metal vapour deposition.

Typically, the coating comprises aluminium applied by aluminium vapour deposition.

As an alternative, the relatively opaque areas can comprise a metal foil.

Preferably, said light sources are interconnected via electrical wiring.

Alternatively, said light sources are electrically independent of one another.

The light sources might alternatively be chemiluminescent glow lights.

DESCRIPTION OF THE ADVANTAGEOUS EFFECT

The present Invention will advantageously provide a banner that is self illuminating and capable of being rolled up or folded to reduce its packing size for transportation purposes.

BRIEF DESCRIPTION OF THE DRAWINGS

Preferred forms of the present Invention will now be described by way of example with reference to the accompanying drawings, wherein.

DESCRIPTION OF THE PREFERRED EMBODIMENT

Figure 1:
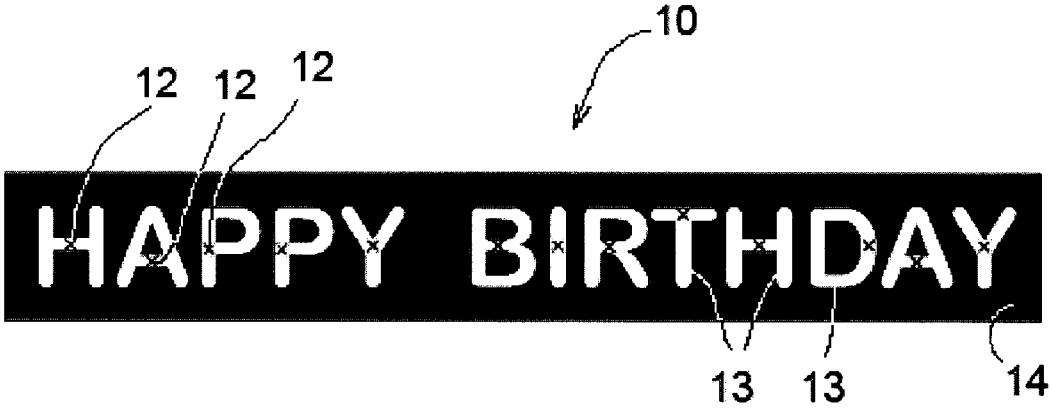
FIG. 1 is a schematic front elevation of a banner comprising text shapes.

In FIG. 1 of the accompanying drawings there is depicted schematically a banner 10. The banner 10 would comprise one or more synthetic plastics or resin films and/or light-transmissive paper or a combination of sheets of each material.

The front-most film of the banner 10 comprises a plurality of shaped light-transmissive text areas 13 which are each backlit by a light source 12. The light transmissive areas might be transparent or translucent or might indeed be cutouts or comprise photosensitive glow treatments.

Figure 2:
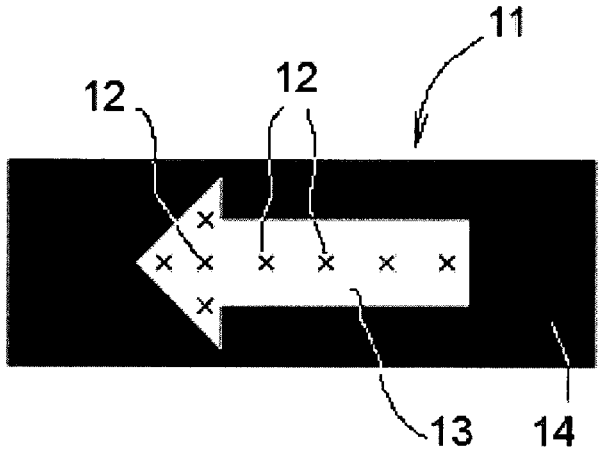
FIG. 2 is a schematic front elevation of a banner comprising a graphic shape.

In the example depicted in FIG. 2, and different banner 11 comprises a single shaped light-transmissive area 13 in the form of a graphic arrow. Being a relatively larger area, many light sources 12 can be provided behind this single shape. In this example, a relatively opaque area 14 surrounds the arrow-shaped area.

As used here in, the phrase "relatively opaque" is intended to mean less light-transmissive than the light-transmissive areas and can include partially or completely opaque.

Figure 3:
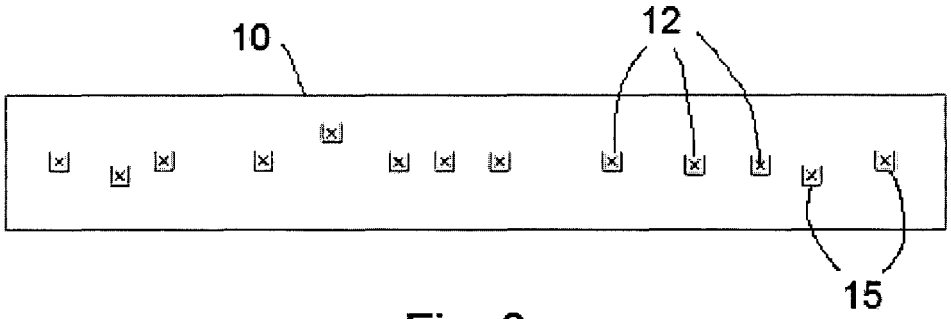
FIG. 3 is a schematic rear elevation of components of the backlighting system employed in the banner of FIG. 1, with independent light sources.
Figure 4:
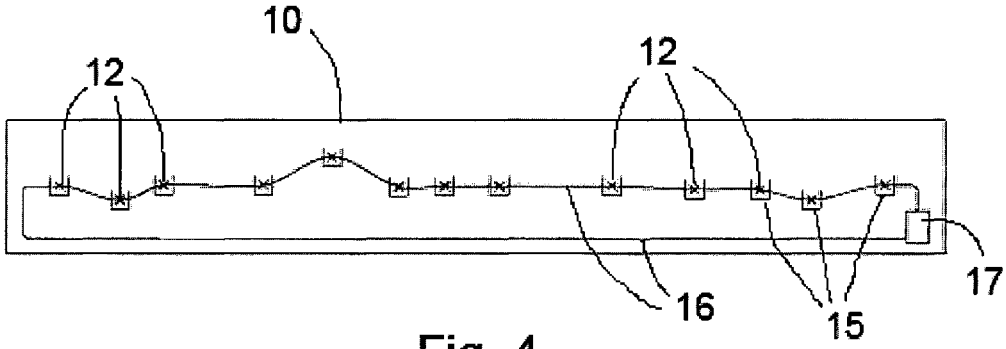
FIG. 4 is a schematic rear elevation similar to FIG. 3, but with light sources interconnected via electrical wiring.
Figure 6:
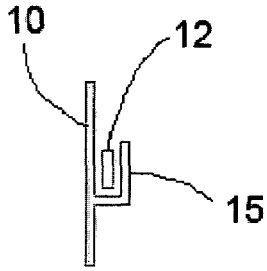
FIG. 6 is a schematic end elevation of another banner.

FIGS. 3 and 4 supplement FIG. 1. In these figures there is depicted a plurality of pockets 15 within each one of which a respective one of the light sources 12 is located. A side elevation of such a pocket is depicted in FIG. 6. Each pocket is positioned behind a single letter of the banner. The pockets are sized and shaped to receive a single chemiluminescent or battery operated light source 12. Battery operated LEDs, electroluminescent devices, light bulbs, low voltage fluorescent lights or any other electrically powered lighting devices can be positioned within each pocket behind the light-transmissive areas. A circuit 16 of flexible wire can "daisy chain"

all the light sources 12 to a single power source 17 which might be a battery pack all AC mains plugpack for example.

Where chemiluminescent lighting devices are chosen, they can be activated individually. Where the light sources are electric, they might also be activated individually, or by a central switch. The switch(s) might be remotely controlled by radio control, "Bluetooth"™ or any other wireless system. The switch(s) might additionally and/or alternatively be controlled by a photo sensor, sound sensor or motion sensor.

The relatively opaque area 14 of the synthetic plastics film or paper top layer of the banner can be made opaque or semi-opaque by a metal vapour deposition process. Alternatively, the synthetic plastics film or paper can be coated or printed with metallic paint, or any other non-transparent paint or ink. As a further alternative, the synthetic plastics film or light transmissive paper could be layered or covered with a metallic foil, a solid dark-coloured synthetic plastics film, all by non-transparent paper with cut-out shapes therein. The internal surface of each pocket 15 is to be highly reflective. To this end, the pocket may comprise metallic foil, or might be formed on synthetic plastics and have a reflective surface produced by any one of the methods described above. This is to ensure that light emanating from the light source 12 is reflected and transmitted more to the front side of the banner.

The relatively opaque area 14 can be covered by metal vapour deposition or other means as described earlier either on the front or rear side thereof. With a highly reflective surface at the rear, this will enhance reflection off the inside surface of the pocket for transmission through the shaped light-transmissive area.

The synthetic plastics film of the banner can contain photo-luminescent colour pigments or the film can be coated or printed with photo-luminescent ink or paint. Alternatively, only the light-transmissive areas of the design might be coated or printed with photo-luminescent ink or paint so that the light emanating from the light source will be enhanced when seen from the front of the banner.

Figure 5:
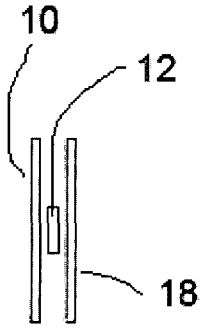
FIG. 5 is a schematic end elevation of a banner.
Figure 7:
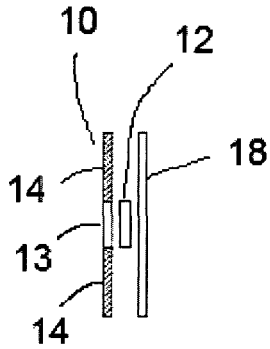
FIG. 7 is a schematic end elevation of yet another banner.

As an alternative to the provision of pockets 15, the light sources 12 might be laminated or otherwise sandwiched between a pair of films. For example as shown in FIG. 5, a light source 12 is shown sandwiched between a front film of the banner 10 and a reflective rear film 18. As shown in FIG. 7, the front film of the banner (comprising light-transmissive area 13 directly in front of the light source 12) is surrounded by relatively opaque areas 14 and a reflective film 18 is provided at the back of a light source to enhance the lighting effect.

Because the film or paper is thin, the banner lends itself to being easily rolled up or folded into a compact size for storage and transportation purposes. Such banners might be used for surprise parties, election campaigns, advertising banners, emergency directional signals (for example a glowing arrow to indicate a fire escape route in buildings, tunnels, railway stations and public arenas for example.)

It should be appreciated that modifications and alterations obvious to those skilled in the art are not to be considered as beyond the scope of the present Invention. For example, rather than providing a plurality of pockets, a substantial portion or the whole area of the banner might comprise a single flexible electroluminescent panel requiring just a pair of electrical connections.

The invention claimed is:

1. A banner, comprising:

a flexible display film comprising light-transmissive areas that are made of polymers and form alphanumeric characters and a relatively opaque area surrounding the light-transmissive areas, a plurality of light sources positioned at least behind each said light-transmissive area, and wherein the light sources are attached to the flexible display film in such manner as to allow rolling up and folding of the banner without removal of the light sources therefrom, and a plurality of flexible light-transmissive pockets attached to the flexible display film and within each of which a said light source is located, and wherein the pockets are located between the flexible display film and the flexible reflective film.

2. The banner of claim 1, wherein the relatively opaque area is made of fibrous material.

3. The banner of claim 2, wherein the fibrous material comprises paper or cardboard.

4. The banner of claim 1, wherein the flexible display film comprises synthetic plastics.

5. The banner of claim 4, wherein the synthetic plastics are selected from the group consisting of: polyethylene; polypropylene; polyethylene terephthalate and nylon.

6. The banner of claim 1, wherein said relatively opaque areas comprise a coating.

7. The banner of claim 6, wherein the coating is applied by metal vapour deposition.

8. The banner of claim 7, wherein the coating comprises aluminium applied by aluminium vapour deposition.

9. The banner of claim 1, wherein said relatively opaque areas comprise a metal foil.

10. The banner of claim 1, wherein said light sources are interconnected via electrical wiring.

11. The banner of claim 1, wherein said light sources are electrically independent of one another.

12. The banner of claim 11, wherein said light sources are chemiluminescent.

13. The banner of claim 12, wherein said light sources are individually battery-operated.

* * * * *